United States Patent [19]

Bergqvist

[11] Patent Number: 4,488,759

[45] Date of Patent: Dec. 18, 1984

[54] DEVICE FOR SUPPLYING FLUID TO A TOOL FOR BREAKING HARD MATERIAL

[75] Inventor: Sven A. Bergqvist, Sandviken, Sweden

[73] Assignee: Santrade Ltd., Lucerne, Switzerland

[21] Appl. No.: 469,742

[22] Filed: Feb. 25, 1983

[30] Foreign Application Priority Data

Mar. 10, 1982 [SE] Sweden ..... 8201491

[51] Int. Cl.[3] ..... E21C 35/22

[52] U.S. Cl. ..... 299/81; 299/86; 299/12

[58] Field of Search ..... 299/81, 86, 17, 12

[56] References Cited

U.S. PATENT DOCUMENTS 4,333,687 6/1982 Barnstorf ..... 299/86

FOREIGN PATENT DOCUMENTS 1126766 6/1982 Canada ..... 299/81

10534 4/1980 European Pat. Off. .

60827 9/1982 European Pat. Off. ..... 299/81

2854307 7/1980 Fed. Rep. of Germany .

608923 5/1978 U.S.S.R. ..... 299/86

*Primary Examiner*—Stephen J. Novosad

*Assistant Examiner*—Mark J. DelSignore

*Attorney, Agent, or Firm*—Burns, Doane, Swecker & Mathis

[57] ABSTRACT

The invention relates to a device for supplying fluid to a tool (10) for breaking hard material, which is rotatably carried in a holder (11). Means are provided for supplying fluid to a nozzle (24) when the tool (10) is displaced axially rearwards during operation, said nozzle being located in connection with the tool (10). For purposes of facilitating rotation of the tool (10) about the longitudinal axis (29) thereof, the device is designed such that a torque is produced acting on the tool, and the tool seat (13,14) in the holder (11) is flushed when the tool (10) is displaced axially rearwards.

12 Claims, 1 Drawing Figure

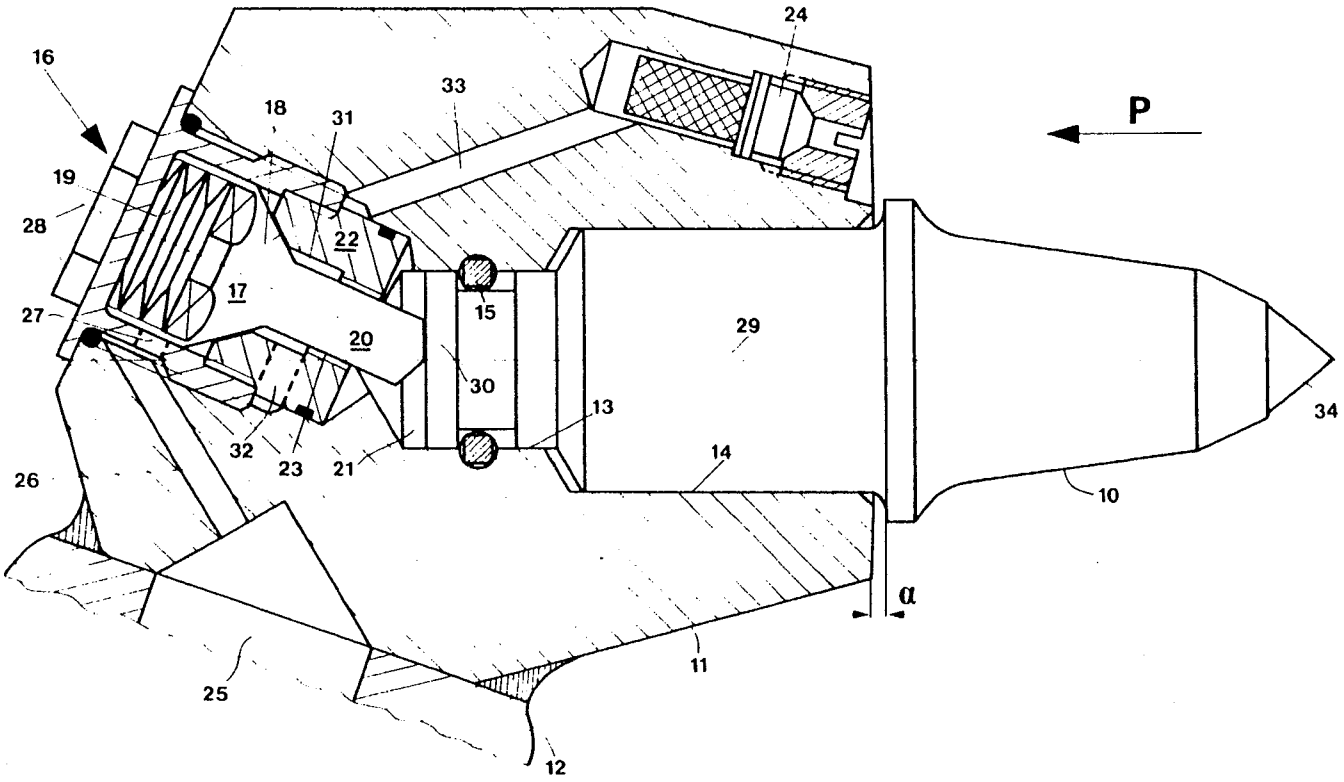
34
P
10
α
24
29
14
11
13
12
15
30
33
20
21
31
22
23
18
17
32
25
16
19
28
27
26

DEVICE FOR SUPPLYING FLUID TO A TOOL FOR BREAKING HARD MATERIAL

The present invention relates to a device for supplying fluid to a tool for breaking hard material, such as coal. The tool is rotatably and axially limitedly movably carried in a holder. Valve means are provided for supplying fluid to a nozzle when the tool is displaced axially rearwards during operation. The nozzle is located proximate to the tool.

In devices of the above type fluid is supplied for purposes of, on the one hand, to cool the tool and thus decrease the risk for spark formation which might cause ignition or gas explosion, and, on the other hand, to limit the generation of dust. In order to restrict the amount of the supplied fluid, the devices are designed such that fluid is supplied only when an axial force is applied on the tool during operation. Such prior art devices are disclosed in, for instance, DE-A-No. 2854307 and EP-A-No. 10534.

The purpose of the present invention is to provide a device for supplying fluid of the above type wherein the rotation of the tool is improved. This and other objects of the invention have been attained by giving the invention the characterizing features stated in the appending claims.

The invention is described in detail in the following with reference to the accompanying drawing in which one embodiment is shown by way of example. It is to be understood that this embodiment is only illustrative of the invention and that various modifications thereof may be made within the scope of the claims.

In the drawing a longitudinal section is shown through a tool holder which is provided with a device according to the invention.

In the illustrated embodiment a tool 10 for breaking hard material, such as coal, is rotatably carried in a holder 11. The holder 11 is welded to a member 12 of a machine for extraction of hard material, such as coal, for instance a cutting head or a cutting drum. In a manner known per se, the tool 10 is rotatably mounted in a seat 13,14 in the holder 11 and axially secured thereto by means of a locking device 15; the locking device 15, however, allowing a limited axial displacement of the tool 10.

In the holder 11 there is provided a valve generally denoted by 16. The valve 16 comprises a valve body or seal body 17 which is sealingly forced against a valve seat 18 by means of a spring packet 19. The valve body 17 is operatively connected to a valve slide 20, which is located axially behind the tool 10 and rests against the rear end face 21 thereof. The valve slide 20 traverses a front end wall 22 in the valve 16 and is designed such that an annular gap 23 is provided between the valve slide and the end wall. For the sake of clarity the height of the annular gap 23 has been exaggerated in the drawing. The longitudinal axis 28 of the valve slide 20 is inclined with respect to the longitudinal axis of the tool 10. The valve slide 20 is provided with an end face 30 which is angled relative to a plane perpendicular to the longitudinal axis 28 and which is intended to rest against the end face 21 of the tool 10.

A nozzle 24 designed in a manner known per se is provided in the holder 11. The nozzle 24 is directed in such a way that a fluid jet emitted therefrom is directed toward the tip of the tool 10.

In the member 12 there is provided a passage 25 which communicates with a fluid source, not shown. Fluid is conducted from the fluid source into the valve 16 through the passage 25, a passage 26 in the holder 11 and a passage 27 in the valve. Fluid flow out of the valve, however, is prevented due to the fact that the valve body 17 sealingly rests against the seat 18.

In operation, when the tool 10 works the material, a force acting in the direction of the arrow P is applied on the tool, which means that the tool is moved axially rearwards a distance a. The tool 10, then, forces the valve slide 20 rearwards against the action of the spring packet 19, thereby causing the valve body 17 to be lifted from the seat 18 and thus allowing fluid to flow into an annular chamber 31. The fluid, then, flows from the chamber 31 through a passage 32 in the valve and a passage 33 in the holder 11 to the nozzle 24, wherefrom a fluid jet is emitted.

The end face 30 of the valve slide 20 is eccentric relative to the longitudinal axis 29 of the tool. This means that the valve slide 20 will produce a torque acting on the tool 10 about the longitudinal axis thereof when the tool 10 during operation is displaced axially rearwards, thus contracting the spring packet 19. This torque contributes to improve the rotation of the tool 10 about the longitudinal axis 19 thereof. Such a rotation is pursued, since it gives a uniform wear of the hard metal tip 34 of the tool; i.e. results in a self-sharpening of the tip.

When the chamber 31 is filled with fluid a portion thereof will flow through the annular gap 23 and then out of the holder 11 through the gap between the tool 10 and the seat 13,14. According to the invention, thus, there is ensured a flushing of the seat 13,14, which facilitates and improves the rotation of the tool 10. Alternatively, in stead of the annular gap 23, there might be provided other passage means in the valve for the fluid flow from the chamber 31 to the seat 13,14, for instance an axial groove on the valve slide 20.

In the illustrated embodiment the valve 16 as well as the nozzle 24 are designed as readily exchangeable separate units. Further, the fluid pressure always acts directly on the valve body 17, which contributes to shut the valve.

I claim:

1. A device for supplying fluid to a tool for breaking hard material, such as coal, said tool being rotatably and axially limitedly movably carried by a holder, valve means provided for supplying fluid to a nozzle when the tool is displaced axially rearwards during operation, said nozzle being arranged proximate to said tool, a valve arranged to be opened in response to axial rearward displacement of said tool to direct fluid to said nozzle, said valve including valve slide means for providing a rotary torque acting on the tool about the longitudinal axis thereof in response to axial rearward displacement of the tool.

2. A device according to claim 1, wherein the valve slide is arranged axially rearwardly of the tool.

3. A device according to claim 1, wherein the longitudinal axis of the valve slide is incined with respect to the longitudinal axis of the tool, the valve slide provided with an end face which forms an angle with a plane perpendicular to the longitudinal axis of the valve slide, said end face being arranged to rest against an end face, on the tool, and a spring for biasing the valve slide, during operation, against the end face of the tool.

4. A device according to claim 3, wherein said end face of the valve slide is eccentric relative to the longitudinal axis of the tool.

5. A device according to claim 4, wherein the valve slide, upon the axial rearward displacement of the tool, is adapted to connect a fluid source to the tool seat in the holder for purposes of flushing the seat.

6. A device according to claim 5, wherein the valve slide is adapted to traverse a fluid chamber in the valve, said fluid chamber communicating with the nozzle, and a seal body in the valve arranged between the fluid source and the fluid chamber, said seal body being operatively connected to the valve slide.

7. A device according to claim 6, wherein the valve slide traverses a front end wall in the valve, and the fluid flows from the fluid chamber through passage means in the valve formed by an annular gap between the valve slide and said end wall, to the tool seat.

8. A device for supplying fluid to a tool for breaking hard material, such as coal, said tool being rotatably and axially limitedly movably carried in a seat of a holder such that a gap is defined between said tool and said seat, valve means provided for supplying a fluid to a nozzle when the tool is displaced axially rearwards along said seat during operation, said nozzle being arranged proximate to said tool, said valve means has a valve slide arranged to be opened by the rearward axial displacement of the tool to connect a fluid source to the tool seat in the holder so that fluid travels between said seat and said tool all the way to a front end of said gap and out of said holder for flushing the seat.

9. A device according to claim 8, wherein the valve slide is arranged to traverse a fluid chamber in the valve, said fluid chamber communicating with the nozzle, a seal body is arranged between the fluid source and the fluid chamber, said seal body being operatively connected to said valve slide, and the valve slide traverses a front end wall in the valve, thereby fluid flows from the fluid chamber through passage means in the valve in the form of an annular gap between the valve slide and the end wall, to the tool seat.

10. A device according to claim 9, wherein the valve slide is adapted to produce a torque acting on the tool about the longitudinal axis thereof upon an axial rearward displacement of the tool.

11. A device according to claim 2, wherein the valve slide, upon the axial displacement of the tool, is adapted to connect a fluid source to a tool seat in the holder for purposes of flushing the seat.

12. A device according to claim 3, wherein the valve slide, upon the axial displacement of the tool, is adapted to connect a fluid source to the tool seat in the holder for purposes of flushing the seat.

* * * * *